US011125033B2

(12) United States Patent
Edvardsen

(10) Patent No.: US 11,125,033 B2
(45) Date of Patent: Sep. 21, 2021

(54) WELLBORE CLEANOUT TOOL

(71) Applicant: Altus Intervention (Technologies) AS, Stavanger (NO)

(72) Inventor: Svein Edvardsen, Borkenes (NO)

(73) Assignee: Altus Intervention (Technologies) AS, Stavanger (NO)

( * ) Notice: Subject to any disclaimer, the term of this patent is extended or adjusted under 35 U.S.C. 154(b) by 0 days.

(21) Appl. No.: 16/763,837

(22) PCT Filed: Dec. 4, 2018

(86) PCT No.: PCT/NO2018/050302
§ 371 (c)(1),
(2) Date: May 13, 2020

(87) PCT Pub. No.: WO2019/112441
PCT Pub. Date: Jun. 13, 2019

(65) Prior Publication Data

US 2020/0300049 A1 Sep. 24, 2020

(30) Foreign Application Priority Data

Dec. 6, 2017 (NO) ..... 20171943

(51) Int. Cl.
*E21B 4/02* (2006.01)
*E21B 4/04* (2006.01)
(Continued)

(52) U.S. Cl.
CPC ..... *E21B 21/08* (2013.01); *E21B 4/02* (2013.01); *E21B 4/04* (2013.01); *E21B 17/22* (2013.01);
(Continued)

(58) Field of Classification Search
CPC ..... E21B 27/04; E21B 37/00; E21B 27/00; E21B 4/04; E21B 21/12
See application file for complete search history.

(56) References Cited

U.S. PATENT DOCUMENTS 6,695,058 B1 2/2004 French
2012/0211229 A1 8/2012 Fielder et al.
(Continued)

FOREIGN PATENT DOCUMENTS

EP 2845995 A1 11/2015
FR 2382259 A1 9/1978
WO 2017142504 A1 8/2017

*Primary Examiner* — Giovanna Wright
(74) *Attorney, Agent, or Firm* — Gable Gotwals

(57) ABSTRACT

A downhole tool string forming a free end portion for performing an operation in a well having a well fluid, the string comprising towards the free end portion; a motor for delivering a rotational speed, a pump connected the motor for circulating the well fluid through a first port and a second port, a gear housing comprising a gear being driven by the pump and delivering a reduced rotational speed, a tool shaft rotatable by the gear at the reduced rotational speed; a reservoir around a section of the tool shaft for collecting dislodged material, and a material dislodging means connected to the tool shaft, wherein the gear housing further comprises a first fluid channel for providing fluid communication between the pump and the first port via the tool shaft being hollow, and a second fluid channel for providing fluid communication between the pump and second port via the reservoir.

9 Claims, 6 Drawing Sheets

(51) Int. Cl.

| | |
|---|---|
| ***E21B 21/12*** | (2006.01) |
| ***E21B 27/04*** | (2006.01) |
| ***E21B 21/08*** | (2006.01) |
| ***E21B 17/22*** | (2006.01) |
| *E21B 7/18* | (2006.01) |
| *E21B 10/18* | (2006.01) |
| *E21B 29/00* | (2006.01) |

(52) U.S. Cl.
CPC ..... *E21B 21/12* (2013.01); *E21B 27/04* (2013.01); *E21B 7/18* (2013.01); *E21B 10/18* (2013.01); *E21B 29/002* (2013.01)

(56) References Cited

U.S. PATENT DOCUMENTS

| | | | | |
|---|---|---|---|---|
| 2014/0326510 | A1 | 11/2014 | Wessel | |
| 2016/0168916 | A1 | 6/2016 | Lakic | |
| 2016/0215564 | A1* | 7/2016 | Andersen | E21B 7/00 |
| 2018/0058146 | A1* | 3/2018 | Grabaek | E21B 4/006 |

* cited by examiner

WELLBORE CLEANOUT TOOL

CROSS-REFERENCE TO RELATED APPLICATIONS

This United States application is the National Phase of PCT Application No, PCT/N02018/050302 filed 4 Dec. 2018, which claims priority to Norwegian Patent Application No. 20171943 filed 6 Dec. 2017, each of which is incorporated herein by reference.

STATEMENT REGARDING FEDERALLY SPONSORED RESEARCH OR DEVELOPMENT

Not applicable

NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURE BY THE INVENTOR OF A JOINT INVENTOR

Not Applicable

BACKGROUND OF THE INVENTION

Field of the Invention

This invention relates to a downhole tool string for performing an operation in a well having a well fluid. More particularly, the invention relates to a downhole tool string for cleaning a wellbore, wherein the downhole tool string comprises a rotatable material dislodging means, a reservoir for collecting dislodged material and a drive system for rotating the material dislodging means and circulating the well fluid through the downhole tool string and past the material dislodging means. The drive system comprising a motor, a pump and at least one gear. The well fluid is circulated past the material dislodging means for suspending the dislodged material and collecting it within the reservoir. The gear is arranged in a gear housing comprising two fluid channels for circulating the well fluid past the gear. The pump is arranged above the gear. The pump is connected to a motor in a first end and to the gear in a second end. The pump transfers a rotational speed from the motor to the gear. The gear is connected to the material dislodging means. The gear reduces the rotational speed from the pump to the material dislodging means. The downhole tool string may be connected to a wireline.

It is known to have an internal pump in a downhole tool string for use in a well. The pump circulates a well fluid and provides fluid to a drill bit, or another type of material dislodging means, in the front of the downhole tool string. Further, the material being dislodged by the drill bit will be suspended in the well fluid when circulating, thus the dislodged material can be transported with the fluid. The material suspended in the well fluid may be collected in the downhole tool string for recovery to a surface.

It is further known to have a motor in the downhole tool string for driving the pump and the drill bit. However, the pump requires a higher rotational speed than the drill bit. Therefore, a gear is arranged to reduce the rotational output from the motor to the drill bit.

Description of Related Art

Patent document EP 2845995 discloses a drilling tool comprising a motor, a pump, a gear and a drilling head, wherein the gear is arranged between the pump and the drilling head. A gear housing and tool housing defines a fluid channel in the gear for providing fluid communication from the pump to the drilling head. Fluid is circulated by the pump through an inlet on the pump and out through the drilling head. A challenge is that the fluid has to be circulated outside the tool to enter the pump. The tool does not have means for collecting debris from drilling.

Patent document EP 3070257 discloses a downhole tool string comprising a motor, a gear, an operational tool and a pump, wherein the pump is arranged between the gear and the operational tool. The operational tool is a milling tool or a drilling tool. The downhole tool string has a small outer diameter for use in well tubulars with small internal diameter. Due to the small outer diameter of the tool string there is no space for a fluid channel through the gear. Thus, the pump must be arranged closer to the operational tool than the gear to enable circulation of the well fluid from the pump to the operational tool. Well fluid is sucked in through inlets on the pump and ejected close to the operational tool. The gear must deliver one rotational speed to the pump and another, lower rotational speed to the operational tool. The downhole tool string may comprise a cleaner/reservoir section arranged between the pump and the operational tool to collect elements released while drilling. A challenge is that the gear has to transfer the rotational output from the motor to both the pump and the operational tool, making it a complicated assembly.

BRIEF SUMMARY OF THE INVENTION

The invention has for its object to remedy or to reduce at least one of the drawbacks of the prior art, or at least provide a useful alternative to the prior art.

More specifically, it is an objective to provide an improved downhole tool string capable of circulating fluid through the gear, allowing dislodging and suspension of debris that may be collected effectively in the reservoir. Even more specifically, it is an objective to provide a downhole tool string configured as a drilling fluid circulation arrangement in one wireline based wellbore cleaning tool string arrangement.

The object is achieved through features, which are specified in the description below and in the claims that follow.

The invention is defined by the independent patent claim. The dependent claims define advantageous embodiments of the invention.

In a first aspect, the invention relates more particularly to a downhole tool string forming a free end portion for performing an operation in a well having a well fluid, the downhole tool string comprising towards the free end portion:

- a motor for delivering a rotational speed;
- a pump connected to the motor for circulating the well fluid through a first port and a second port;

a gear housing comprising a gear, the gear being connected to the pump for reducing the rotational speed;

a tool shaft rotatable by the gear;

a reservoir around a section of the tool shaft for collecting dislodged material, and a material dislodging means connected to the tool shaft, wherein the gear housing further comprises a first fluid channel for providing fluid communication between the pump and the first port via the tool shaft being hollow, and a second fluid channel for providing fluid communication between the pump and the second port via the reservoir, the second port being arranged between the material dislodging means and the reservoir.

The invention solves the above-mentioned challenges by having a gear housing with two fluid channels, allowing well fluid to flow to and from the pump, passing the gear. Circulation of the well fluid to the pump within the downhole tool string, rather than outside, enables the well fluid to enter the downhole tool string close to the free end portion of the downhole tool string, rather than at the pump. Thus, the well fluid has a shorter distance to travel before it enters the downhole tool string. Enabling the well fluid to flow past the gear means the pump can be arranged above the gear. Thus, the gear only has to transfer the rotational output from the motor to the material dislodging means, resulting in a simple gear assembly.

The material dislodging means is arranged to work loose unwanted material debris in the well, e.g., but not limited to, scale, hydrates, sand and silt. Dislodging material may be performed by mechanical intervention or fluid jetting. Well fluid may be provided around or passed the material dislodging means for suspending the dislodged material in the well fluid. The well fluid may be circulated by the pump. The well fluid may be ejected out through the first port and sucked in through the second port. The first port may be arranged on the material dislodging means. In one embodiment, the first port may be an outlet and the second port may be an inlet. In one embodiment, the first port may be an inlet and the second port may be an outlet for reversing the circulation of well fluid. The dislodged material may be transported with the well fluid to the reservoir. The dislodged material may be collected in the reservoir for recovery to a surface. In one embodiment, the downhole tool string may comprise at least one sensor and a control unit for registering a level of material in the reservoir. In another embodiment, the downhole toolstring may comprise at least one sensor and a control unit for registering parameters relevant to downhole dislodging and collection, e.g., but not limited to) torque, RPM, pressure, flow, viscosity and density.

The tool shaft may have a first end portion and a second end portion, the first end portion being arranged closest to the free end portion of the downhole tool string. The material dislodging means may be connected to the first end portion of the tool shaft and at least a part of the material dislodging means may be rotated by the tool shaft. The tool shaft may comprise a fluid channel providing fluid communication between the material dislodging means and the first fluid channel in the gear housing. The second end portion of the tool shaft may be connected to a first end of the gear for rotating the tool shaft. The first end of the gear being arranged closer to the free end portion of the downhole tool string than a second end of the gear.

The second end of the gear may be connected to the pump for driving the gear. The gear is configured to reduce the rotational output speed from the pump to the tool shaft. The pump may be in fluid communication with the first and second fluid channel in the gear housing. The pump may suck well fluid through the second fluid channel and eject well fluid through the first fluid channel.

In one embodiment, the first fluid channel and/or the second fluid channel may be an annular fluid channel.

The pump may be driven by a motor, e.g. an electric motor or a hydraulic motor, for delivering a rotational speed to the pump. In one embodiment, a shaft may connect the pump to the motor. In one embodiment, the motor may be connected to a control unit for adjusting the rotational speed.

In one embodiment, a second gear may be arranged between the motor and the pump for altering the rotational speed from the motor to the pump. In one embodiment, the second gear may be configured to increase the rotational speed from the motor to the pump. In another embodiment, the second gear may be configured to reduce the rotational speed from the motor to the pump. Using a gear between the motor and the pump may alter the pressure output from the pump without having to change the motor if it does not have sufficient capacity to deliver the required rotational speed for a given pressure output from the pump.

The second port may be arranged in proximity to the material dislodging means. In one embodiment, the second port may be arranged between the material dislodging means and the reservoir. In one embodiment, the second port may be arranged on a lower end portion of the reservoir. The second port may be arranged in proximity to the material dislodging means to reduce the distance the well fluid has to travel before entering the downhole tool string. Reducing the distance may increase the capability to collect material from the well.

In one embodiment, the material dislodging means may be derived from a group of tools comprising a drilling tool, a milling tool and a jetting tool. In one embodiment, the material dislodging means may be a drilling tool such as a rolling cutter bit or a fixed cutter bit. In one embodiment, the material dislodging means may be a milling tool such as a taper mill, a cement mill or a pilot mill. In one embodiment, the material dislodging means may be a jetting tool comprising one or several nozzles for directional ejection of the well fluid.

The downhole tool string may comprise a rotatable screw for distributing and retaining the dislodged material in the reservoir. The rotatable screw may spread the dislodged material over a length of the reservoir to avoid material settling in the bottom of the reservoir. In one embodiment, the screw may be an auger.

In one embodiment, the rotatable screw may be arranged on a section of the tool shaft. The screw may be connected to the tool shaft to rotate with the tool shaft. In one embodiment, the screw may be arranged to rotate in the opposite direction of the tool shaft.

The downhole tool string may comprise a filter for retaining dislodged material within the reservoir. The filter allows well fluid to escape the reservoir. The filter may be arranged below the gear housing to avoid debris from entering the gear housing, and further enter the pump. The filter may encircle the tool shaft.

In one embodiment, the pump may circulate the well fluid in through the second port and out through the first port. In one embodiment, the circulation may be reversed, circulating well fluid out through the second port and in through the first port. Reversing the circulation may be beneficial if for example the filter gets clogged by debris. Reversing the flow may flush clean the filter.

In one embodiment, the downhole tool string may comprise a coupling section configured to take up an axial load.

The coupling section may be configured to absorb an axial load if the loading on the material dislodging means exceeds a predefined value. In one embodiment, the coupling section may comprise a hydraulic actuator for absorbing the axial load. In one embodiment, the coupling section may comprise a spring and/or damper for absorbing the axial load.

In a second aspect, the invention relates to a downhole tool string assembly comprising the downhole tool string and a wireline for connection to the downhole tool string. The downhole tool string assembly may be connected to the wireline. The wireline may lower or hoist the tool string into or out of a wellbore. The wireline may transmit electric energy between the tool string and e.g. a control unit and/or power source at the surface.

In one embodiment, the downhole tool string assembly may comprise a wireline tractor for displacing the tool string in a well. The wireline tractor may be connected to the tool string for displacing the tool string in the well. The wireline tractor may adjust the axial load on the material dislodging means, for example to avoid jamming or overloading of the material dislodging means. The wireline tractor may anchor the tool string assembly to the wellbore for avoiding rotation of the tool string assembly when the material dislodging means is operated. The wireline may be connected to the wireline tractor.

BRIEF DESCRIPTION OF THE SEVERAL VIEWS OF THE DRAWINGS

In the following is described examples of a preferred embodiments illustrated in the accompanying drawings, wherein.

DETAILED DESCRIPTION OF THE INVENTION

Figure 1:
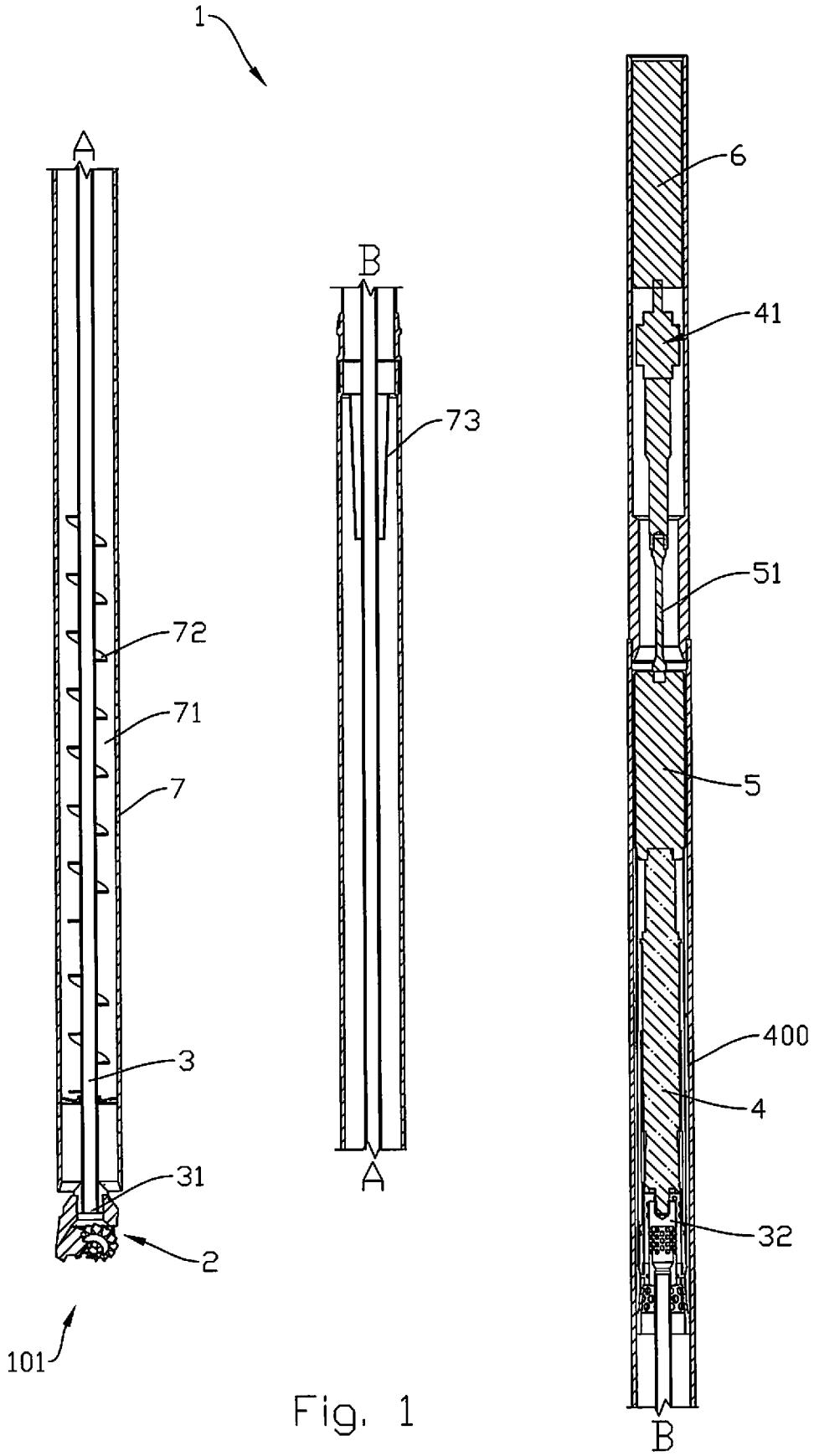
FIG. 1 shows a cross section of a downhole tool string according to one embodiment of the invention. The downhole tool string is split into three sections for illustration purposes.

The figures are depicted in a simplified manner, and details that are not relevant to illustrate what is new with the invention may have been excluded from the figures. The different elements in the figures may necessarily not be shown in the correct scale in relation to each other. Equal reference numbers refer to equal or similar elements. In what follows, the reference numeral 1 indicates a downhole tool string according to the invention. The downhole tool string 1 comprises a material dislodging means 2, in the figures depicted as a drill bit, connected to a first end portion 31 of a tool shaft 3. A second end portion 32 of the tool shaft 3 is connected to a gear 4. A pump 5 is connected to the gear 4 for driving the gear 4, the pump 5 being driven by a motor 6, in the figures depicted as an electric motor.

FIG. 1 shows the downhole tool string 1 split into three sections for illustration purposes. In use, the three sections would be arranged in series with the ends A-A and B-B adjoining each other. The drill bit 2 is rotatable for dislodging material in a well (not shown). The drill bit 2 is rotated by the tool shaft 3. In another embodiment, the material dislodging means may be a milling bit or a jetting tool. A jetting tool may comprise one or several nozzles for ejecting well fluid, thereby dislodging material in the well. The nozzle(s) may be rotated by the tool shaft 3. The tool shaft 3 extends through a housing 7, a portion of the internal volume of the housing 7 being configured as a reservoir 71 for collecting debris from the well. The tool shaft 3 is arranged with a screw 72, in the figure shown as an auger. The screw 72 rotates with the tool shaft 3 to distribute the debris in the reservoir 71. A filter 73 retains material in the reservoir 71, but allows well fluid to escape the reservoir 71.

The second end portion 32 of the tool shaft 3 is connected to the gear 4. The gear 4 is connected to the pump 5 configured to drive the gear 4. The pump 5 is connected to the motor 6 by means of a shaft 51 for driving the pump 5. The pump 5 is driven with a rotational speed delivered from the motor 6. The rotational speed is continued by the pump 5 to the gear 4. The gear 4 reduces the rotational speed to drive the tool shaft 3 at a lower rotational speed than the pump 5. In this particular embodiment, a second gear 41 is arranged between the motor 6 and pump 5. The second gear 41 being configured to alter the rotational speed from the motor 6 to the pump 5. The motor 6 receives energy through a wireline (see FIG. 5*a*) from an energy source at the surface.

Figure 2:
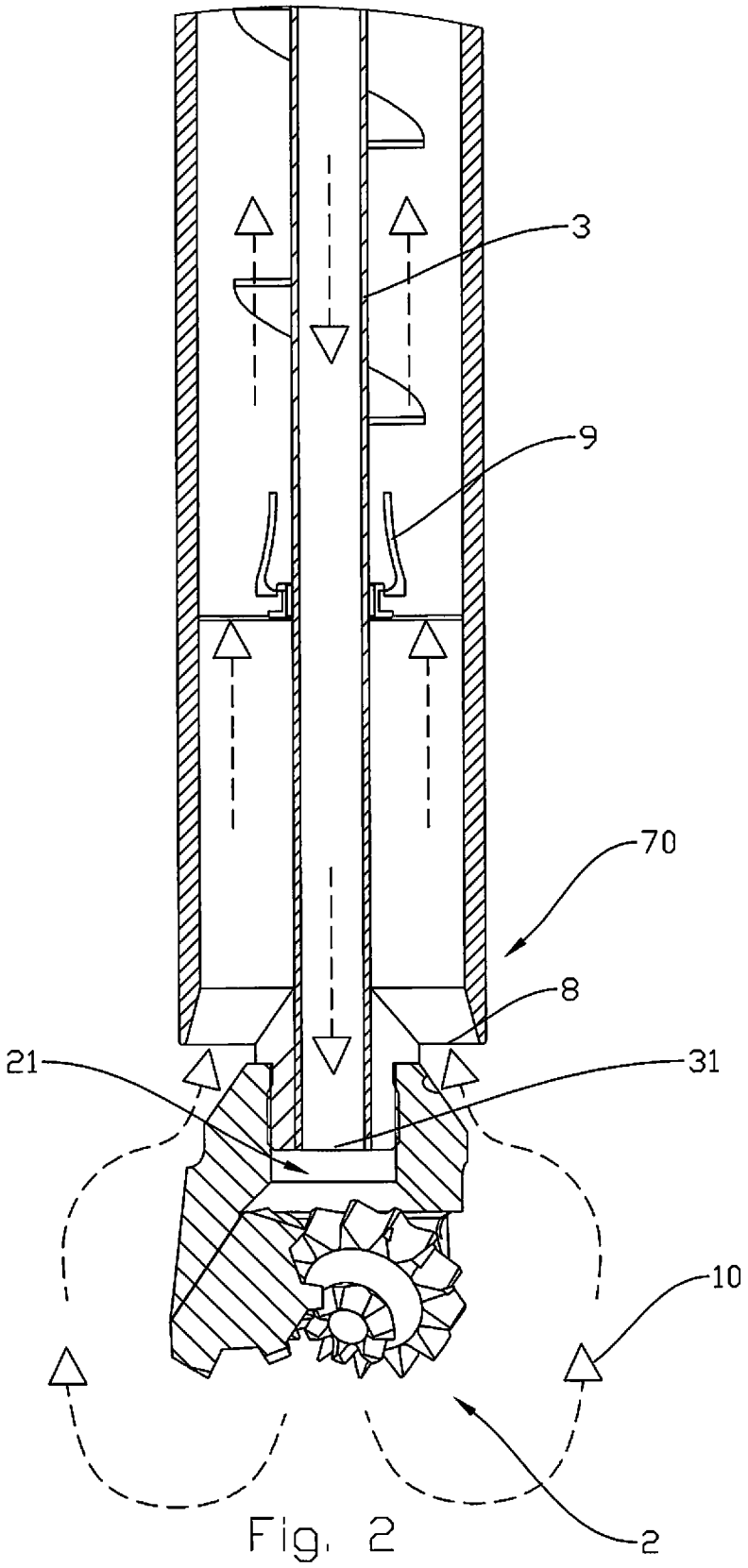
FIG. 2 shows a cross section, in a larger scale than FIG. 1, of a bottom section of the downhole tool string comprising a drilling bit and a lower portion of a reservoir.

FIG. 2 shows the free end portion of the downhole tool string 1. Well fluid 10, illustrated with arrows, may be circulated out through an outlet 21 on the drill bit 2 and in through an inlet 8. Circulating the well fluid 10 while drilling will suspend the dislodged material in the well fluid 10 and the material may be transported with the flow of well fluid 10. The inlet 8 is arranged on a lower end 70 of the housing 7 to reduce the distance the dislodged material has to be transported with the well fluid 10 before entering the downhole tool string 1. In one embodiment, the inlet 8 may be arranged further from the drill bit 2. A check-valve 9 allows flow of well fluid 10 into the reservoir 71, but restricts return flow.

Figure 3:
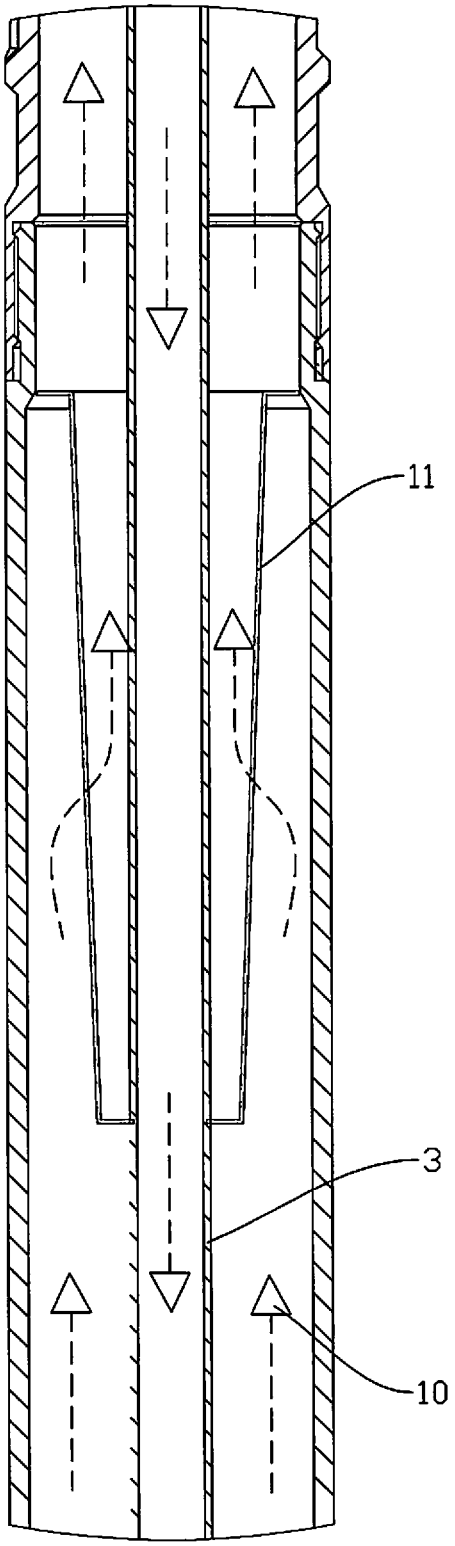
FIG. 3 shows a cross section, in the same scale as FIG. 2, of a section of the downhole tool string comprising an upper portion of the reservoir.

FIG. 3 shows an upper portion of the reservoir 71. A filter 11 is arranged concentrically around the tool shaft 3 to filtrate particles from the well fluid 10. The filter 11 retains particles of a certain size, dependent on the filter mesh, but allows fluid to pass through.

Figure 4:
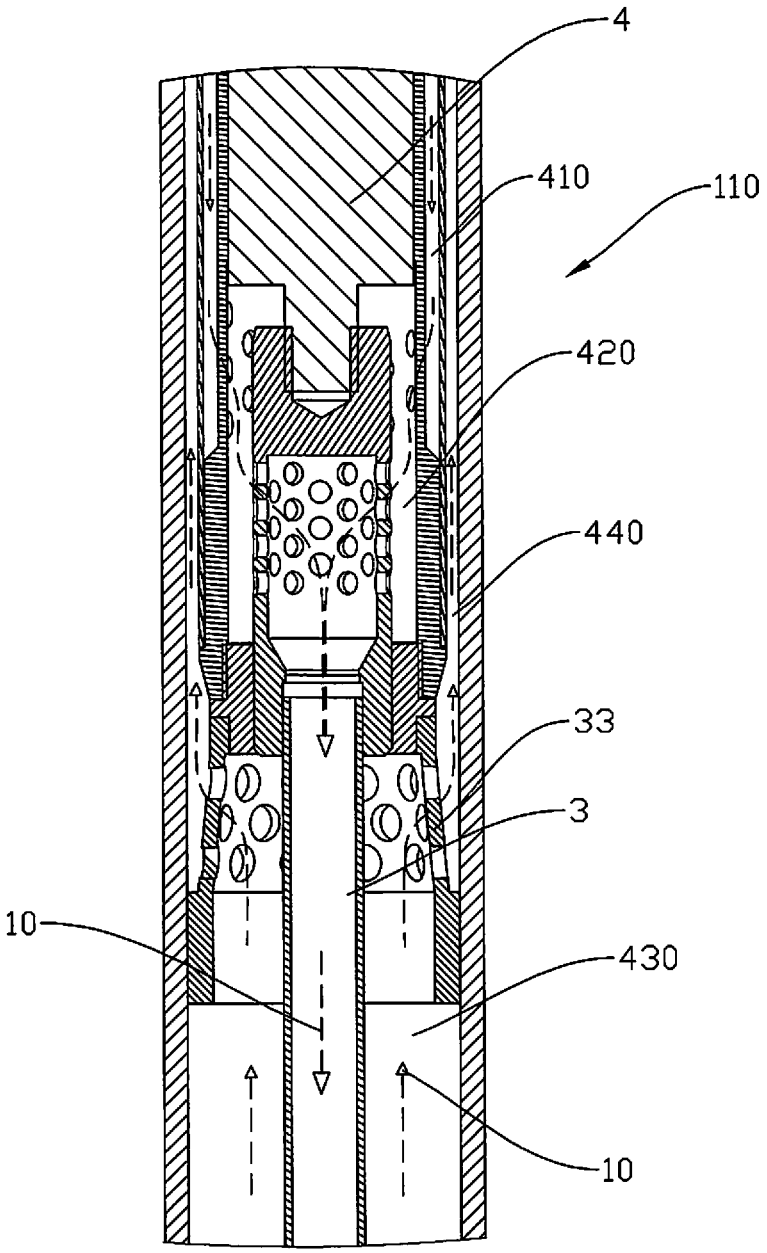
FIG. 4 shows a cross section, in the same scale as FIG. 2, of a section of the downhole tool string comprising an upper portion of a tool shaft and a lower portion of a gear.

FIG. 4 shows a cross-section of a connection area 110 between the tool shaft 3 and the gear 4. In use, the motor 6 drives the pump 5 to push well fluid 10 from the pump 5 around the gear 4 in a first annular fluid channel 410 inside the gear housing 400. The well fluid 10 enters the tool shaft 3 through a perforated section 420 on the tool shaft 3. The tool shaft 3 is hollow and acts as a conduit for the well fluid 10, guiding the well fluid 10 to the outlet 21 on the drill bit 2. The pump will suck well fluid 10 through the second port and around the tool shaft 3 in an annulus 430. The well fluid 10 enters a second annular fluid channel 440 through a perforated section 33 concentrically arranged around the tool shaft 3. The second annular fluid channel 440 in the gear housing 400 guides the well fluid 10 past the gear 4 and to the pump 5.

Figure 5:
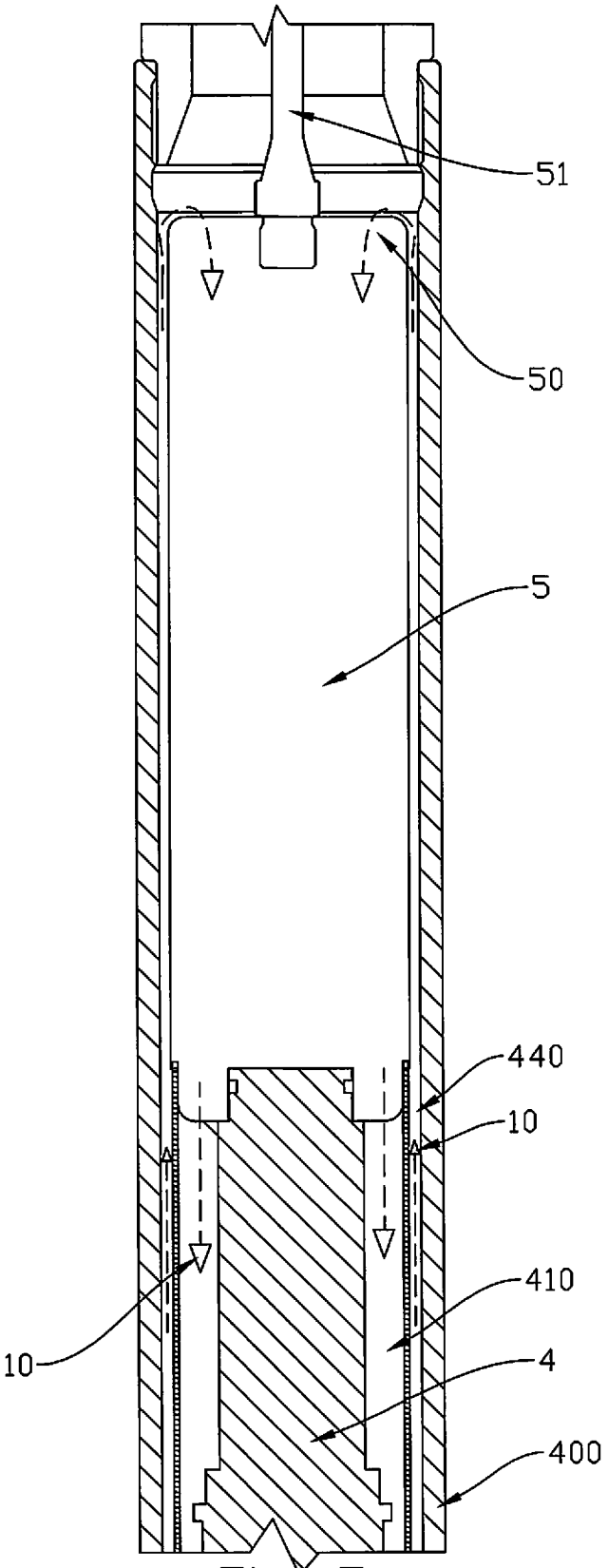
FIG. 5 shows a cross section, in the same scale as FIG. 2, of a section of the downhole tool string comprising an upper portion of a gear and the pump.

FIG. 5 shows the well fluid 10 being pumped into the first annular fluid channel 410 in the gear housing 400 from the pump 5, and further past the gear 4. Well fluid 10 flowing towards the pump 5 passes the pump 5 in the second annular fluid channel 440 and enters the pump 5 through a top portion 50 of the pump 5. The well fluid 10 is recycled by the pump 5, and pumped back into the first annular fluid channel 410. It should be understood that the well fluid 10 may flow the opposite direction to what is described above if circulation is reversed.

Figure 6A:
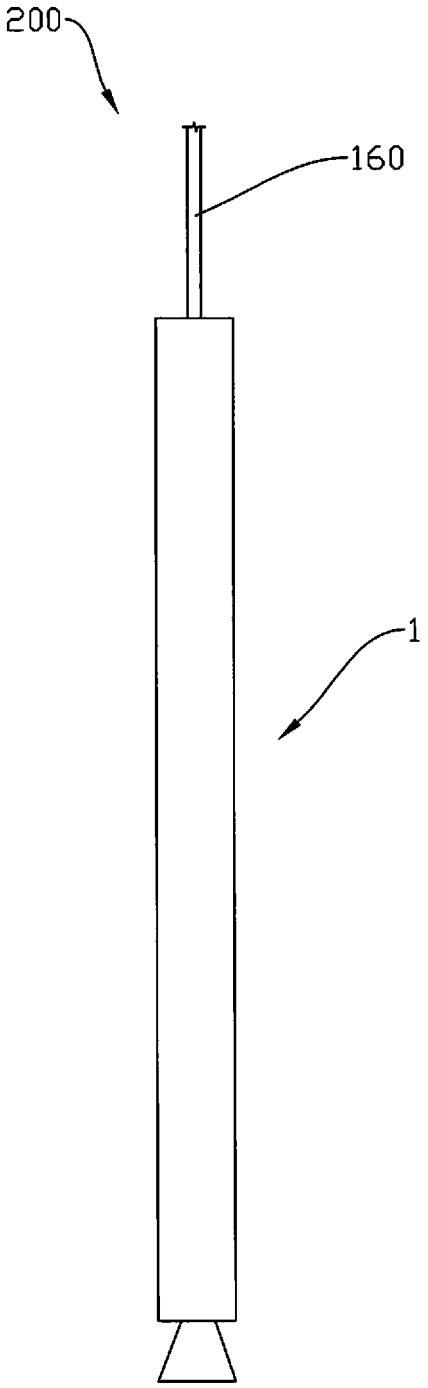
FIG. 6*a* shows the downhole tool string assembly according to one embodiment of the invention, where the downhole tool string being connected to a wireline.

FIG. 6*a* shows a downhole tool string assembly 200. The downhole tool string 1 is connected to a wireline 160. The wireline 160 extends to the surface and can transmit power to and control signals to and from the tool string 1. The wireline 160 can lower and hoist the tool string 1 in the well.

Figure 6B:
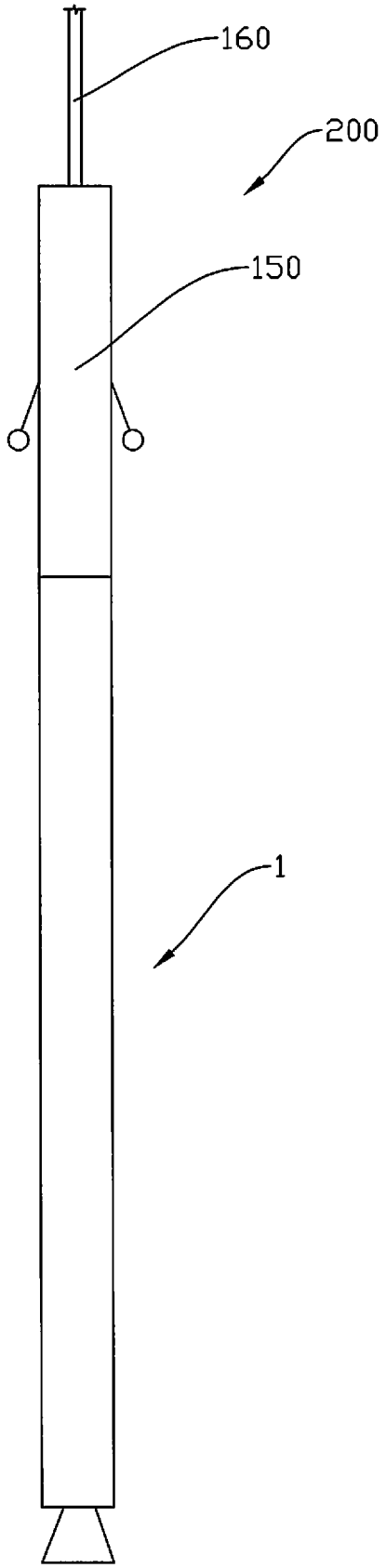
FIG. 6*b* shows the downhole tool string assembly according to one embodiment of the invention, where the downhole tool string being connected to a wireline tractor, the wireline tractor further being connected to a wireline.

FIG. 6*b* shows another embodiment of the downhole tool string assembly 200. The downhole tool string 1 being connected to a wireline tractor 150. The wireline tractor 150 can displace the downhole tool string 1 in the well.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A wireline based downhole tool string forming a free end portion for performing an operation in a well having a well fluid, the downhole tool string comprising towards the free end portion:

a motor for delivering a rotational speed;

a pump for circulating the well fluid through a first port at the free end portion of the downhole tool string, and through a second port at the free end portion of the downhole tool string, the pump being connected to the motor;

a gear housing comprising a gear, the gear being driven by the pump and delivering a reduced rotational speed, the reduced rotational speed being lower than the rotational speed of the motor;

a hollow tool shaft rotatable by the gear at the reduced rotational speed, the tool shaft being continuous hollow from the gear housing to the free end portion;

a reservoir for collecting dislodged material, the reservoir being around a section of the hollow tool shaft, and a material dislodging means connected to the hollow tool shaft, wherein the gear housing further comprises a first fluid channel for providing fluid communication between the pump and the first port via the hollow tool shaft, and a second fluid channel for providing fluid communication between the pump and the second port via the reservoir.

2. The wireline based downhole tool string according to claim 1, comprising a second gear arranged between the motor and pump for altering the rotational speed from the motor to the pump.

3. The wireline based downhole tool string according to claim 1, wherein the second port is arranged in proximity to the material dislodging means.

4. The wireline based downhole tool string according to claim 1, wherein the material dislodging means is derived from a group of tools consisting of a drilling tool, a milling tool or a jetting tool.

5. The wireline based downhole tool string according to claim 1, comprising a rotatable screw for distributing and retaining dislodged material in the reservoir.

6. The wireline based downhole tool string according to claim 5, wherein the rotatable screw is arranged on a section of the tool shaft within the reservoir.

7. The wireline based downhole tool string according to claim 1, comprising a filter for retaining dislodged material within the reservoir.

8. A wireline based downhole tool string assembly comprising the downhole tool string according to claim 1 and a wireline for connection to the downhole tool string.

9. The wireline based downhole tool string assembly according to claim 8, comprising a wireline tractor for displacing the tool string in a well.

* * * * *